US007361064B2

(12) United States Patent
Chien et al.

(10) Patent No.: US 7,361,064 B2
(45) Date of Patent: Apr. 22, 2008

(54) CONDUCTIVE CONTACT AND ELECTRONIC APPARATUS EMPLOYING THE SAME

(75) Inventors: Chih-Wei Chien, Guangdong (CN); Chang-Hsuan Chen, Guangdong (CN)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 34 days.

(21) Appl. No.: 11/308,980

(22) Filed: Jun. 2, 2006

(65) Prior Publication Data

US 2007/0066129 A1 Mar. 22, 2007

(30) Foreign Application Priority Data

Sep. 16, 2005 (CN) ..... 2005 1 0037349

(51) Int. Cl.
*H01R 4/48* (2006.01)

(52) U.S. Cl. ..... 439/824

(58) Field of Classification Search ..... 439/824, 439/862, 700, 500, 66, 660, 817, 840, 81
See application file for complete search history.

(56) References Cited

U.S. PATENT DOCUMENTS 5,149,598 A * 9/1992 Sunshine ..... 429/1
5,259,786 A * 11/1993 Huang ..... 439/500
5,664,973 A 9/1997 Emmert et al.
5,980,335 A 11/1999 Barbieri et al.
6,231,394 B1 * 5/2001 Schnell et al. ..... 439/630
6,375,474 B1 * 4/2002 Harper et al. ..... 439/66
6,635,383 B2 * 10/2003 Maple ..... 429/178
6,814,623 B2 * 11/2004 Hashiba ..... 439/660
6,817,588 B2 * 11/2004 Tsai ..... 248/562
6,887,085 B2 * 5/2005 Hirai ..... 439/82
6,929,483 B2 * 8/2005 Huang et al. ..... 439/66
6,994,566 B2 * 2/2006 You ..... 439/66
7,074,048 B2 * 7/2006 Liao et al. ..... 439/66
2001/0016452 A1 * 8/2001 Miyamoto et al. ..... 439/500
2005/0026499 A1 2/2005 Choi
2005/0085140 A1 * 4/2005 Lai ..... 439/862
2006/0276063 A1 * 12/2006 Guichard et al. ..... 439/81

* cited by examiner

*Primary Examiner*—Gary F. Paumen
(74) *Attorney, Agent, or Firm*—Winston Hsu

(57) ABSTRACT

A conductive contact includes a resilient strip and a post. The resilient strip includes a fixed end configured as a sheet for securing the resilient strip, an arm configured for being resiliently deformed by pressure, and a free end. The fixed end and the free end are arranged at two opposite ends of the arm, and the resilient strip is constructed as a substantially convolute shape. The post is secured with the free end for being detachably and conductively in contact with a conductive pad.

20 Claims, 6 Drawing Sheets

CONDUCTIVE CONTACT AND ELECTRONIC APPARATUS EMPLOYING THE SAME

FIELD OF THE INVENTION

The present invention relates to a conductive contact and, more particularly, to an electronic apparatus employing the conductive contact.

DESCRIPTION OF RELATED ART

Conductive contacts are generally applied in electronic apparatuses such as mobile phones, portable computers and personal digital assistants (PDAs) for making electrical connections between two specific elements thereof.

Referring to FIG. 1, an electronic apparatus 10 employing a plurality of general conductive contacts 12 is illustrated. The electrical apparatus 10 includes a shield 102 defining a plurality of guiding holes 104 therein, a body 105 defining a plurality of cylindrical space 106 therein, and a circuit board 108 fixed to a bottom of the body 105. Each conductive contact 12 includes a post 120 and a coil spring 122. The post 120 inserts into the guiding hole 104 and is bound by the shield 102. The coil spring 122 axially spirals to form as a cylindrical shape and is accommodated in the cylindrical space 106 for resiliently supporting one end of the post 120. The circuit board 108 electrically connects and supports the coil spring 122. The post 120 perpendicularly moves relative to the shield 102 via both guidance of the hole 104 and resilient support of the coil spring 122. Another end of the post 120 is in contact with or separated from a specific element such as a grounding pad of a circuit board (not shown).

The coil spring 122 may be pressed under an axial load transmitted via the post 120 so that an axial height of the coil spring 122 can be shortened to some extent. However, it is space-consuming and incompetent for the coil spring 122 to be utilized in a compact space. Furthermore, it is more incompetent for the coil spring 122 to be accommodated in the compact space if the compact space is a complex, step-shaped space. Resilience performance of the coil spring 122 may be lowered if it is configured shorter to fit the compact and complex space.

Therefore, a conductive contact with a compact structure is desired.

SUMMARY OF THE INVENTION

A conductive contact includes a resilient strip and a post. The resilient strip includes a fixed end configured as a sheet for securing the resilient strip, an arm configured for being resiliently deformed by pressure, and a free end. The fixed end and the free end are arranged at two opposite ends of the arm, and the resilient strip is constructed as a substantially convolute shape. The post is secured to the free end for being detachably and conductively in contact with a conductive pad.

Other advantages and novel features will become more apparent from the following detailed description of preferred embodiments when taken in conjunction with the accompanying drawings, in which:

DETAILED DESCRIPTION OF THE INVENTION

Electronic apparatuses can be portable computers, docking stations, foldable disk players, and other electronic apparatuses. In the following embodiments, a system including a portable computer and a docking station is used as an example for illustration.

Figure 1:
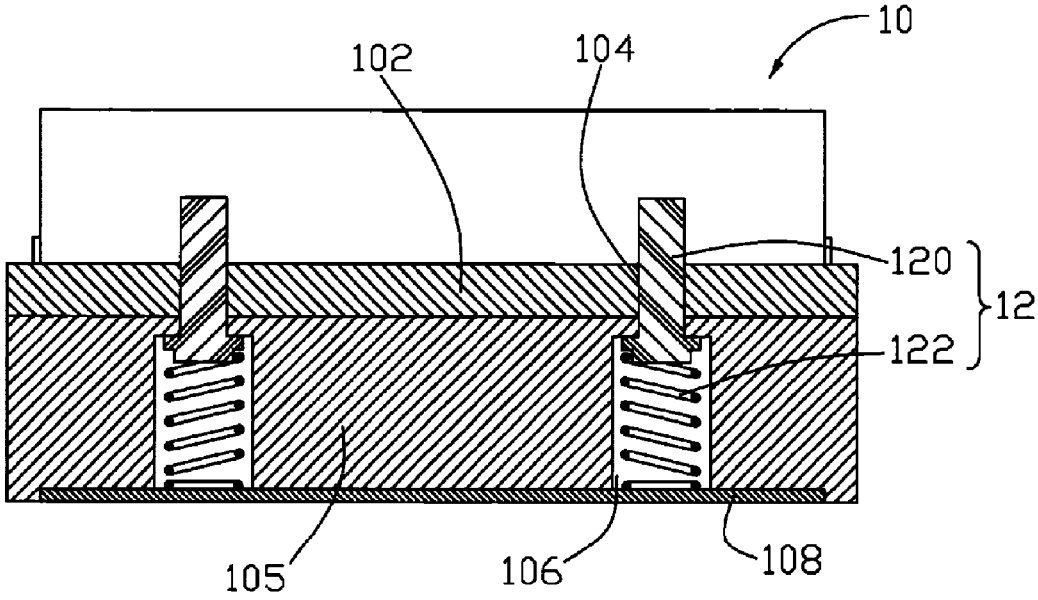
FIG. 1 (Background Art)
FIG. 1 is a sectional view of an electronic apparatus, with a general conductive contact being employed therein.
Figure 2:
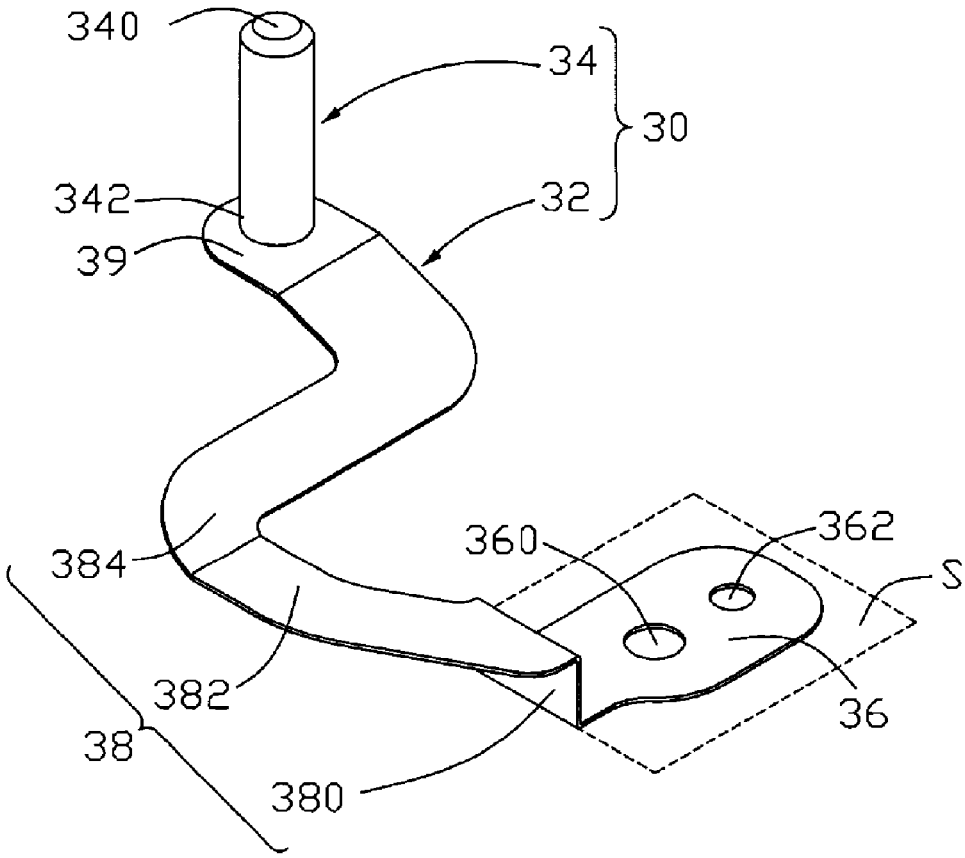
FIG. 2 is an isometric view of a conductive contact in accordance with an exemplary embodiment.

Referring to FIG. 2, a conductive contact 30 includes a resilient strip 32 and a post 34 secured to the resilient strip 32. The resilient strip 32 is a substantially convolute shape, and is made of a metal sheet or other conductive materials. The resilient strip 32 includes a fixed end 36, an arm 38, and a free end 39. The fixed end 36 and the free end 39 are kept apart from each other and are arranged at two opposite ends of the arm 38. The arm 38 includes a connecting portion 380, a first resilient portion 382 and a second resilient portion 384. The connecting portion 380 perpendicularly extends from an end of the fixed end 36, and connects an adjacent distal end of the first resilient portion 382. The fixed end 36 defines an imaginary plane S so that an orientation of the resilient strip 32 may be described conveniently by the following description.

Figure 3:
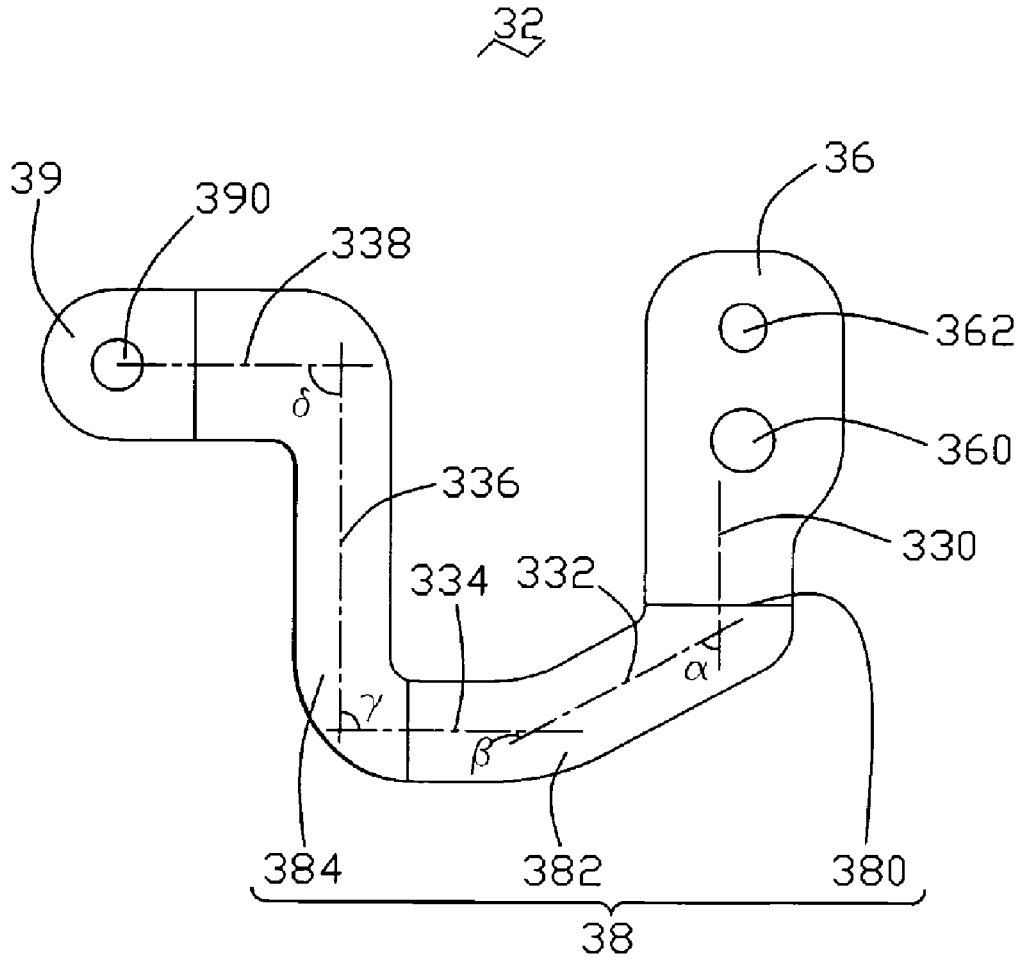
FIG. 3 is a top view of the conductive contact of FIG. 2, with a post being removed.

Referring also to FIG. 3, a top view of the resilient strip 32 is illustrated as a substantial wandering u shape. The fixed end 36 extends a predetermined distance in a first direction 330. The first resilient portion 382 is first clockwise bent in a second direction 332. An angle $\alpha$ is defined between the first direction 330 and the second direction 332, with a being approximately 61.5 degrees. After extending a predetermined distance in the second direction 332, the first resilient portion 382 is again clockwise bent in a third direction 334. An angle $\beta$ is defined between the second direction 332 and the third direction 334, with $\beta$ being approximately 28.5 degrees. The second resilient portion 384 connects the first resilient portion 382 at an extended distal end of the first resilient portion 382, and then is clockwise bent in a fourth direction 336. An angle $\gamma$ is defined between the third direction 334 and the fourth direction 336, with $\gamma$ being approximately 90 degrees. That is, the fourth direction 336 is substantially parallel to the first direction 330. After extending a predetermined distance in the fourth direction 336, the second resilient portion 384 is finally anticlockwise bent in a fifth direction 338. An angle $\delta$ is defined between the fifth direction 338 and the fourth direction 336, with $\delta$ being approximately 90 degrees. That is, the fifth direction 338 is substantially perpendicular to the fourth direction 336. The arm 38 is continuously twisted about four times. The free end 39 connects an extended distal end of the second resilient portion 384. The fixed end 36 defines a first fixing hole 360 for a fastener such as a screw (not shown) being screwed therethrough, and a positioning hole 362 for a positioning element such as a positioning pin being inserted therein so as to prevent the fixed end 34 from rotating. The free end 39 defines a second fixing hole 390 therein for securing the post 34 thereon.

Figure 4:
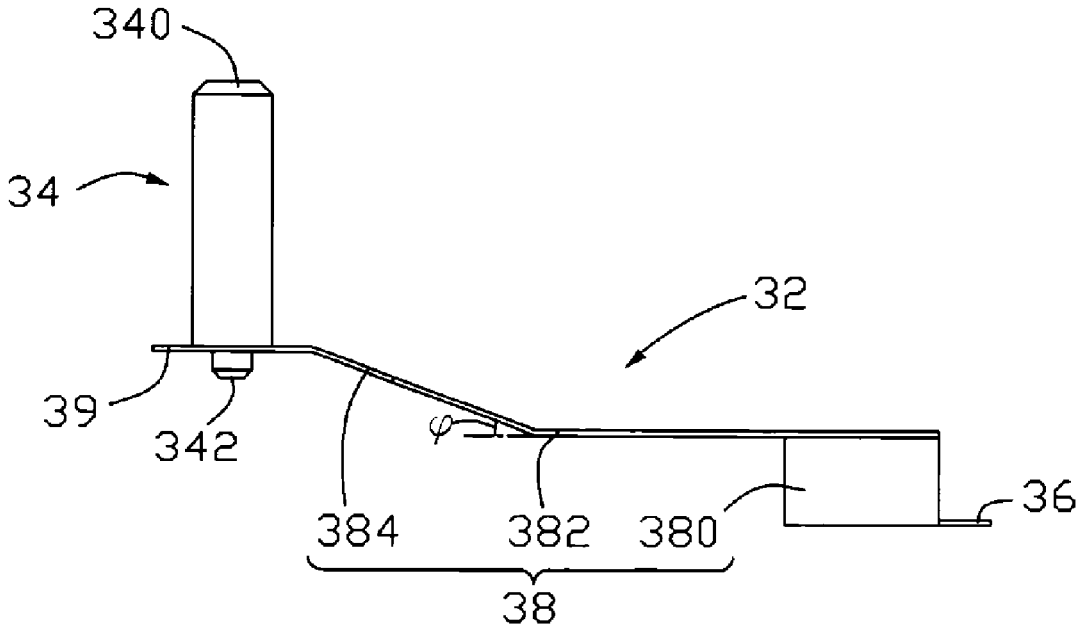
FIG. 4 is a side view of the conductive contact of FIG. 2.

Referring also to FIG. 4, a side view of the resilient strip 32 is illustrated as a substantially stepped shape. The fixed end 36, the first resilient portion 382 and the free end 39 are flat sheets and parallel to each other. The second resilient portion 384 is also a flat sheet and interconnects the first resilient portion 382 and the free end 39. The second resilient portion 384 is bent at an angle $\phi$ with respect to the first resilient portion 382, with $\phi$ being approximately 20 degrees.

The post 34 includes a free portion 340 and an opposite fixed portion 342. The post 34 is secured on the free portion 39 via the fixed portion 342 engaging with the second fixing hole 390.

Figure 5:
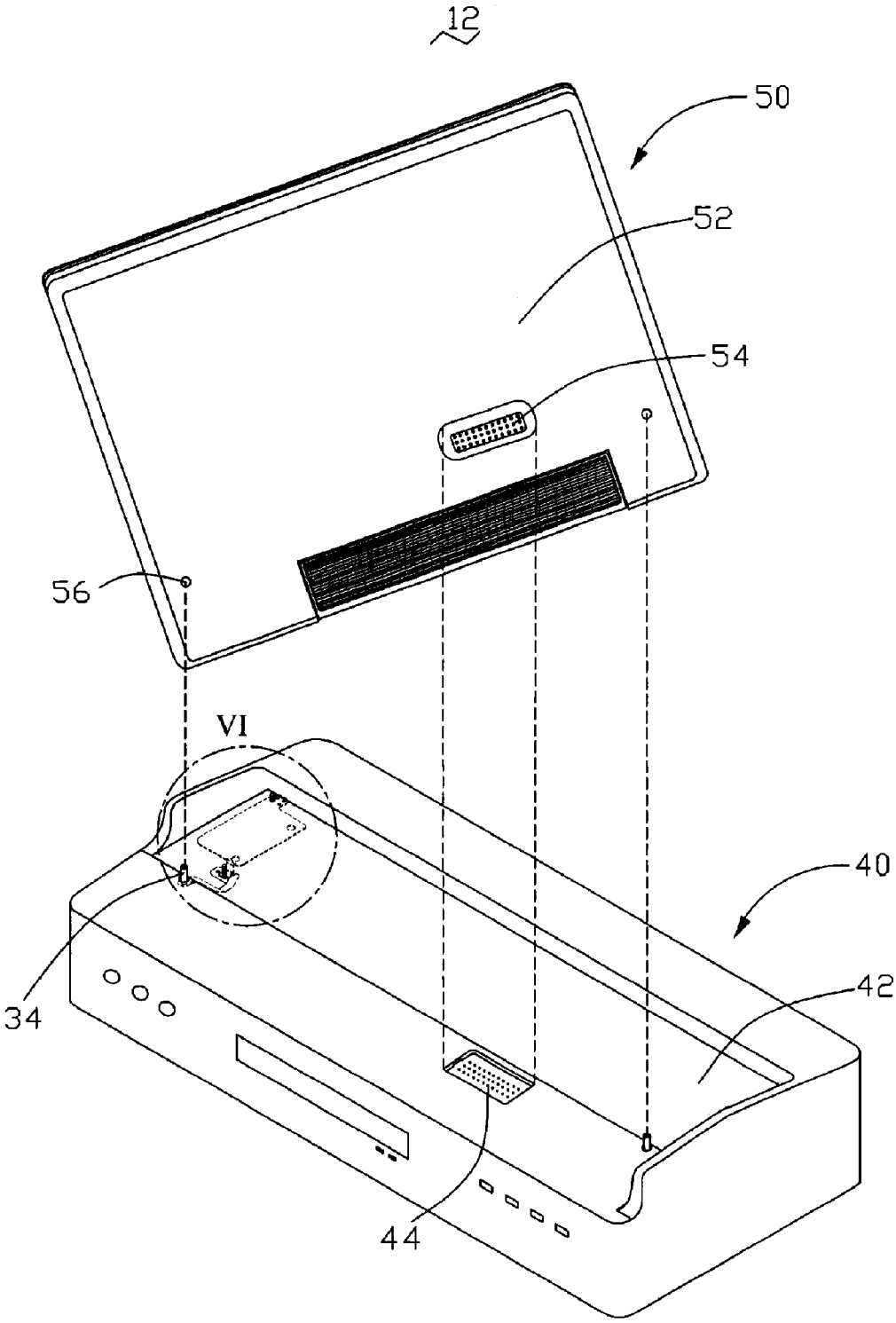
FIG. 5 is an isometric view of an assembly of a portable computer and a docking station with the conductive contact of FIG. 2 therein.
Figure 6:
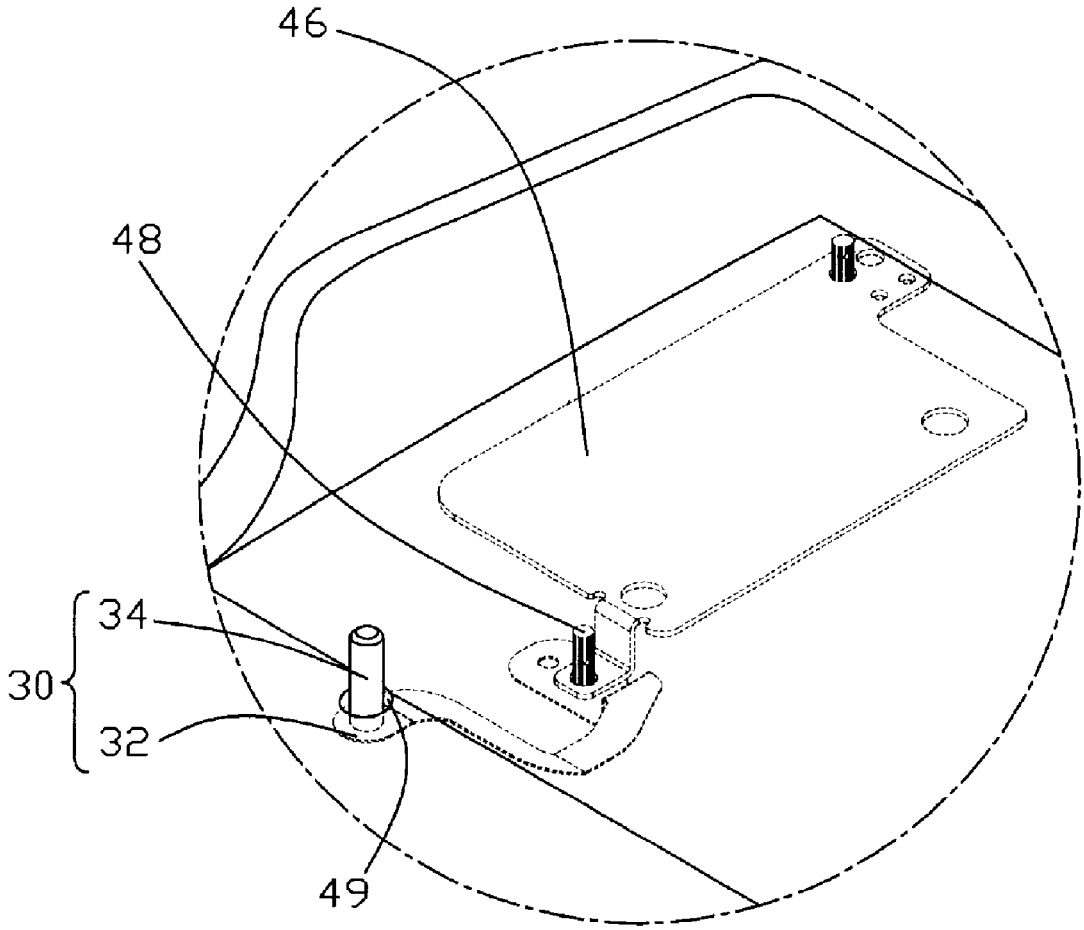
FIG. 6 is an enlarged, perspective view of a circled portion VI of FIG. 5.

Referring also to FIGS. 5 to 6, a system 12 of a docking station 40 and a portable computer 50 is illustrated. The docking station 40 includes an upper plate 42, a connector 44, a grounding sheet (or a circuit board) 46, a screw 48, and the previously described conductive contact 30. The conductive contact 30 and the grounding sheet 46 are secured under the upper plate 42 via the screw 48. The docking station 40 defines a thin, stepped space therein for the resilient strip 32 being accommodated therein. A through hole 49 is defined in the upper plate 42 for the post 34 protruding therethrough. The portable computer 50 includes a bottom plate 52, a complementary connector 54 fixed on the bottom plate 52, and a conductive pad 56 provided on a circuit board (not shown) and exposed on an outside of the portable computer 50.

When the portable computer 50 is incorporated to the docking station 40 so as to assemble the system 12, the complementary connector 54 aligns with the electronic connector 44 whilst the conductive pad 56 aligns with the post 34. Once the conductive pad 56 is in contact with the free portion 340 of the post 34, a pressure is applied on the post 34 to press the post 34 downward. The arm 38 of the resilient strip 32 is resiliently deformed. The post 34, the conductive pad 56 and the grounding sheet 46 are electrically connected. The conductive pad 56 is grounded to the grounding sheet 46 so that an electro magnetic interference (EMI) generated between the docking station 40 and the portable computer 50 may be suppressed.

When the portable computer 50 is detached from the docking station 40, the post 34 is restored and resiliently raised in a direction that the portable computer 50 moves away from the docking station 40 because of the resilience of the resilient strip 32.

In the above described embodiments, the resilient strips 32 are constructed in convolute u shapes in the top views whilst the resilient strip 32 is constructed in a stepped shape in the side view. Therefore, a compact structure of the resilient strip 32 with a less height and a larger width than that of the coil spring 122 is suitable for being accommodated in the thin stepped space defined by the docking station 40. The free end 39 is positioned above the fixed end 36 so as to get a sufficient space for the free end 39 to move downwards when the post 34 is pressed. Therefore, the resilient strips 32 are adapted for compact and step-shaped space.

It is noted that the resilient strip 32 may be integrally formed with the corresponding post 34. The post 34 may be hollow for saving material and weight. Joints between the connecting portion 380 and the first resilient portion 382, or between the first resilient portion 382 and the second resilient portion 384 may be formed as curved shapes in side view. The conductive contact 30 may be employed in a charging apparatus as a charging contact to provide an electrical current to charge a rechargeable battery of an electronic apparatus, such as a cell phone, besides being a grounding contact in a grounding apparatus such as the docking station 40. Each of these angles (e.g. $\alpha$, $\beta$, $\gamma$, $\delta$, and $\phi$) may be greater or less than the above described degrees it possesses. The connecting portion 380 may be omitted and the first resilient portion 382 can be connected to the fixed end 36 directly if the heights from the free end 39 to the corresponding fixed end 36 are sufficient. The connecting portion 380 may be a flat or curved sheet.

The embodiments described herein are merely illustrative of the principles of the present invention. Other arrangements and advantages may be devised by those skilled in the art without departing from the spirit and scope of the present invention. Accordingly, the present invention should be deemed not to be limited to the above detailed description, but rather by the spirit and scope of the claims that follow, and their equivalents.

The invention claimed is:

1. A conductive contact comprising:

a resilient strip constructed in a substantially convolute shape, comprising a fixed end configured for securing the resilient strip and defining an imaginary plane, an arm configured for being resiliently deformed by pressure, and a free end, the fixed end and the free end being arranged at two opposite ends of the arm; and a post secured to the free end for detachably and conductively contacting with a conductive pad.

2. The conductive contact as claimed in claim 1, wherein the arm comprises a first resilient portion and a second resilient portion connected to each other.

3. The conductive contact as claimed in claim 2, wherein the first resilient portion is bent and extends a predetermined length with respect to the fixed portion, and then is bent and extends a predetermined length again to connect to the second resilient portion, when the first resilient portion is viewed in a direction perpendicular to the imaginary plane.

4. The conductive contact as claimed in claim 3, wherein the second resilient portion is bent and extends a predetermined length with respect to the first resilient portion, and then is bent and extends a predetermined length again to connect to the free end, when the second resilient portion is viewed in a direction perpendicular to the imaginary plane.

5. The conductive contact as claimed in claim 2, wherein the resilient strip further comprising a connecting portion interconnecting the fixed end and the first resilient portion.

6. The conductive contact as claimed in claim 1, wherein the fixed end and the free end are spaced apart from each other when both of them are viewed in a direction perpendicular to the imaginary plane.

7. The conductive contact as claimed in claim 1, wherein the resilient strip is configured as a substantial $\upsilon$ shape when it is viewed in a direction perpendicular to the imaginary plane.

8. The conductive contact as claimed in claim 2, wherein the resilient strip is constructed as a substantial stepped shape, and the second resilient portion is bent with respect to the first resilient portion when the resilient strip is viewed in a direction parallel to the imaginary plane.

9. The conductive contact as claimed in claim 8, wherein the fixed end, the first resilient portion and the free end are parallel to each other when the resilient strip is viewed in a direction parallel to the imaginary plane.

10. A conductive contact comprising:

a resilient strip comprising a fixed end configured as a sheet for securing the resilient strip and defining an imaginary plane, an arm configured for being resiliently deformed by pressure, and a free end, the fixed end and the free end being arranged at two opposite ends of the arm, and the resilient strip being constructed as a substantially convolute shape; and a post secured on the free end for detachably and conductively contacting a conductive pad.

11. The conductive contact as claimed in claim 10, wherein an orthographic projection view of the fixed end and the second the free end keeps apart from each other.

12. The conductive contact as claimed in claim 10, wherein an orthographic projection view of the resilient strip on the imaginary plane is configured as a substantial υ shape.

13. The conductive contact as claimed in claim 10, wherein the arm comprises a first resilient portion and a second resilient portion connected to each other.

14. The conductive contact as claimed in claim 13, wherein the orthographic projection view on the imaginary plane of the first resilient portion is bent and extends a predetermined length with respect to the fixed portion, and then is bent and extends a predetermined length again to connect the second resilient portion.

15. The conductive contact as claimed in claim 14, wherein the orthographic projection view on the imaginary plane of the second resilient portion is bent and extends a predetermined length with respect to the first resilient portion, and is further bent and extends a predetermined length to connect the free end.

16. The conductive contact as claimed in claim 10, wherein the resilient strip is constructed as a substantial stepped shape when it is viewed in a direction perpendicular to the imaginary plane.

17. The conductive contact as claimed in claim 16, wherein the resilient strip is a flat sheet, the fixed end, the first resilient portion and the free end are parallel to each other, the second resilient portion are bent with respect to the first resilient portion.

18. An electronic apparatus comprising:

a conductive contact comprising:

a resilient strip comprising a fixed end configured as a sheet for securing the resilient strip and defining an imaginary plane, an arm configured for being deformed by pressure, and a free end, the fixed end and the free end being arranged at two opposite ends of the arm, and the resilient strip being constructed as a substantially convolute shape when the resilient strip is viewed in a direction perpendicular to the imaginary plane whilst being constructed as a substantial stepped shape when the resilient strip is viewed in a direction parallel to the imaginary plane; and a post secured on the free end; and a housing for accommodating the conductive contact.

19. The electronic apparatus as claimed in claim 18, wherein the arm comprises a first resilient portion and a second resilient portion connected to each other, the first resilient portion is bent and extends a predetermined direction with respect to the fixed portion, and then is further bent and extends a predetermined direction to connect to the second resilient portion; the second resilient portion is bent and extends a predetermined direction with respect to the first resilient portion, and then is bent and extends a predetermined direction again to connect to the free end.

20. The electronic apparatus as claimed in claim 18, wherein the resilient strip is configured as a substantial υ shape when it is viewed in the direction perpendicular to the imaginary plane.

* * * * *